US005316461A

United States Patent [19]

Silvestri

[11] Patent Number: 5,316,461

[45] Date of Patent: May 31, 1994

[54] APPARATUS FOR PRODUCING REINFORCED CONCRETE COMPONENTS

[75] Inventor: Silvestro Silvestri, Ca' di David, Italy

[73] Assignee: Immobiliare Centro Nord S.p.A., S. Bonifacio, Italy

[21] Appl. No.: 718,039

[22] Filed: Jun. 20, 1991

[30] Foreign Application Priority Data

Jun. 21, 1990 [IT] Italy ..... 84963 A/90
Jun. 21, 1990 [IT] Italy ..... 84964 A/90

[51] Int. Cl.[5] ..... B28B 13/06; B28B 23/06

[52] U.S. Cl. ..... 425/111; 249/66.1; 249/77; 249/93; 425/289; 425/315; 425/436 R; 425/444; 425/453

[58] Field of Search ..... 425/111, 62, 63, 110, 425/182, 289, 308, 315, 436 R, 436 RM, 444, 452, 453; 249/66.1, 77, 78, 79, 93

[56] References Cited

U.S. PATENT DOCUMENTS 3,732,053 5/1973 Glass ..... 425/289
3,822,861 7/1974 Scott ..... 254/93 HP
3,832,118 8/1974 Leonard et al. ..... 425/443
4,289,293 9/1981 Cashion ..... 425/441
4,409,159 10/1983 Parkins ..... 425/111

FOREIGN PATENT DOCUMENTS 309328 3/1989 European Pat. Off. .
2304455 10/1976 France .
2353377 12/1977 France .
2483306 12/1981 France .

OTHER PUBLICATIONS

World Patents Index, Derwent Publications Ltd., London, GB; AN-E4048B & SU-A-613-900 (Reinforced Concrete) May 27, 1978.

*Primary Examiner*—Jay H. Woo
*Assistant Examiner*—James P. Mackey
*Attorney, Agent, or Firm*—Guido Modiano; Albert Josif

[57] ABSTRACT

The apparatus includes a heatable casting bed, a device for tensioning a reinforcement member at the casting bed, a finishing machine movable along the casting bed for casting a component, a cutter for cutting the reinforcement member, a plurality of roller trucks arranged like a train and of increasing height for wedge-like penetration between the component and the casting bed, a slider roller bed at a rear end of the plurality of roller trucks having a length equal to the casting bed length, an actuation device for generating relative motion between the roller trucks, sliding roller bed and casting bed, in order to transfer the component from the casting bed to the sliding roller bed, and a cutting station for cutting the component into segments.

18 Claims, 8 Drawing Sheets

APPARATUS FOR PRODUCING REINFORCED CONCRETE COMPONENTS

BACKGROUND OF THE INVENTION

The present invention relates to a process and to an apparatus for producing reinforced concrete components.

A process for producing concrete components, in particular components lightened by holes, is known which entails: laying and pretensioning a reinforcement frame, formed by a plurality of wires or strands, over one or more casting channels or beds which are 120 meters or more in length; casting concrete by means of a vibratory finishing machine or an extruder which performs a slow extrusion along the reinforcement frame; partially heated setting of the casting or component; cutting and consequently relaxing and cutting of the strands at the ends of the set casting; sectioning the casting into segments, for example by means of a saw or a disk which can be moved along the casting bed, and; removal of the segments or panels, performed by using a gantry crane which places the segments on appropriate removal trucks.

The solutions already proposed, although satisfactory from many points of view, allow to achieve only a limited productivity.

Furthermore, the preparation of the required prestress frames and the ordinary frames required to reinforce the components, especially large ones, cannot be performed easily and economically on-site, i.e. in the same place where the casting is performed.

Furthermore, the fact that the saw has to be moved to divide the component into segments on the casting bed is a factor which heavily affects the productivity of the above described process, since the casting bed remains occupied by the component for a long time even after setting is complete.

SUMMARY OF THE INVENTION

The aim of the present invention is to provide a process and apparatus for producing reinforced concrete components, lightened by holes or not, which achieves a much greater productivity than that of the apparatuses and processes known in the state of the art.

Within the above aim, an object of the present invention is to provide a process and an apparatus for producing reinforced concrete components which, despite considerably increasing the daily component production capacity, do not entail an increase in personnel or the use of qualified personnel and are therefore extremely competitive with respect to conventional processes and apparatuses.

Another object of the present invention is to allow, besides the removal of the component from the casting bed, the transfer of said component toward a fixed cutting station for cutting it to the required sizes.

The advantages obtained by this operation consist in concentrating the cutting operation in a single confined location, allowing to reduce the levels of noise and residual dust and sludge, which are dispersed along the entire casting bed area in conventional apparatuses.

According to a first aspect of the present invention, a process for producing prefabricated reinforced concrete components is provided which comprises the steps of providing and pretensioning reinforcement members on at least one casting bed; casting concrete by extrusion on said at least one casting bed around the reinforcement members; setting the cast concrete component, relaxing and cutting the reinforcement members at the ends of the set component, characterized in that it comprises the step of gradually separating the component from the casting bed starting from one end up to the other end of the set component by means of a plurality of roller trucks which, by resting on the surface of said at least one casting bed, are interposed between said surface and the component, by generating relative motion between the roller trucks and the casting bed.

Advantageously, the relative motion between the roller trucks and the casting bed can be performed by means of an actuation device which can either pull the trucks along a fixed casting bed or can pull or push the movable casting bed against a fixed roller truck.

According to another aspect of the present invention, an apparatus for carrying out the above described process is provided which comprises at least one casting bed equipped with heating means arranged below the casting surface of the bed for setting the casting, an anchor head for reinforcement members arranged at the ends of said at least one casting bed, a unit for pretensioning the reinforcement members, at least one finishing machine movable along said at least one casting bed and being adapted to cast concrete by extrusion onto the casting bed, and cutting means for cutting the reinforcement members at the ends of the casting bed, characterized in that it comprises a plurality of roller trucks slidingly arranged on a support aligned with the casting bed so as to constitute an extension thereof, said roller trucks increasing in height starting from the end proximate to the casting bed so as to be able to exert a wedge-like penetration action between the casting bed and the set component located thereon for gradually separating said component from said casting bed; a sliding roller bed which is substantially equal in length to the casting bed and is arranged at the rear end of said plurality of roller trucks; actuation means for generating relative motion between the trucks, the sliding roller bed and the casting bed, whereby to facilitate transfer of the unsectioned component from the casting bed to the sliding roller bed, and; a station for cutting the component into segments arranged downstream said sliding roller bed.

Advantageously, the actuation means pull the trucks and the sliding roller bed toward and against the casting bed, if said bed is fixed, or move the casting bed and a component formed thereon toward and against the fixed set and respective sliding roller bed, if the casting bed is movable.

BRIEF DESCRIPTION OF THE DRAWINGS

Further characteristics and advantages of the present invention will become apparent from the following detailed description of embodiments thereof, given with reference to the accompanying drawings, wherein.

DESCRIPTION OF THE PREFERRED EMBODIMENTS

Figure 1:
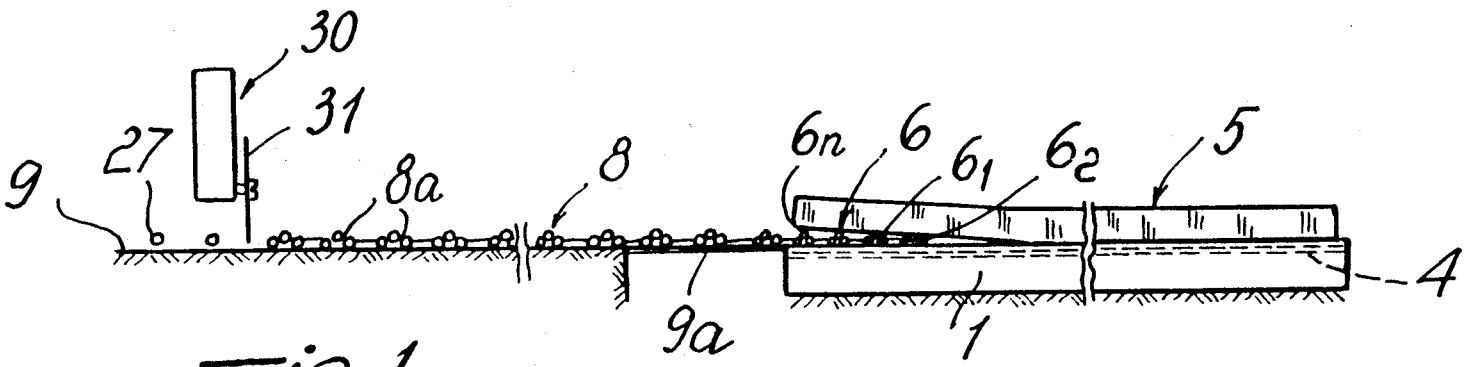
FIG. 1 is a schematic side view of a fixed casting bed on which a set concrete component is cast, at the beginning of the separation from the casting bed for transfer onto a train of roller trucks.

In the above figures, identical or similar parts have been indicated by the same reference numerals.

Initially with reference to FIGS. 1 to 5, the reference numeral 1 indicates a fixed casting bed within which coils 4 for circulating superheated water or another suitable convection fluid are provided.

An anchoring head (for example such as the one generally indicated by T1 in FIG. 7) for a plurality of steel reinforcement frame wires or strands for prestressed reinforced concrete is provided at each end of the casting bed 1. Each anchoring head can be of the conventional type, formed by a comb and by a cross-member or die in which the wires or strands are inserted.

Said wires or strands are locked to the cross-members by means of conical bushes or conical reinforcement clamps, as is conventional in the art.

A conventional hydraulic pretensioning unit (not illustrated in the drawings), for example of a conventional type, is provided at one end of the casting bed adjacent to the respective anchoring head.

Once the reinforcement bars are locked behind both cross-members, they are prestressed by means of the conventional hydraulic pretensioning unit.

A conventional vibratory finishing machine or extruder, is then advanced on the casting bed 1, along which the prestressed reinforcement cage, cables or bars extend; said machines perform the extrusion casting of a hyper-vibrated panel or finished component capable of maintaining the shape imparted thereto, possibly with internal ports or holes for lightening the finished component.

The usual finishing operations, such as the numbering or marking of the component, are preferably performed to the rear of the advancing vibratory finishing machine or extruder.

A plastic sheet (not illustrated) is generally applied over the fresh component by means of an appropriate sheetlaying unit formed by a carriage which is slidable along the bed 1 and supports a sheet rolling drum.

Warm water at approximately 100° C., or superheated water at over 100° C., is then fed through the coils 4 to heat, by radiation and convection, the component 5 to a temperature of approximately 60°-80° C. for approximately six or eight hours according to the initial temperature of the concrete. The setting time is generally comprised between 6 and 12 hours.

Once setting is completed, one end of the component 5 is raised by means of a gantry crane, and a set of roller trucks 61, 62 is inserted between the component 5 and the casting bed 1, in order of increasing height, said set of roller trucks being arranged at the front end of a strain 8 of trucks 8*a* (FIG. 2) which are all identical and each of which supports a removal roller 18.

The trucks 8*a* are for example slidingly mounted on tracks or on a sliding runway 9 which constitutes a longitudinal extension of the casting bed 1 and is substantially as long as the bed 1. A longitudinal insert, formed for example by a bridge-shaped portion 9*a* which is also aligned with the bed 1, is provided between the sliding runway 9 and the bed 1.

Each truck 61, 62 . . . 6*n*, as well as each truck 8*a*, is advantageously constituted (FIGS. 3-5) by two side walls 10 and 12 and by an intermediate wall 13 which are connected together by transverse tension elements, a front element 14 and a rear element 15. Three rollers, i.e. two lower rollers 16 and 17 for rolling on the casting bed 1 and an upper intermediate roller 18 which protrudes upward above the walls 10, 12 and 13 to constitute a rotatable support for the component 5, are slidingly mounted between the side walls 10, 12.

Figure 5:
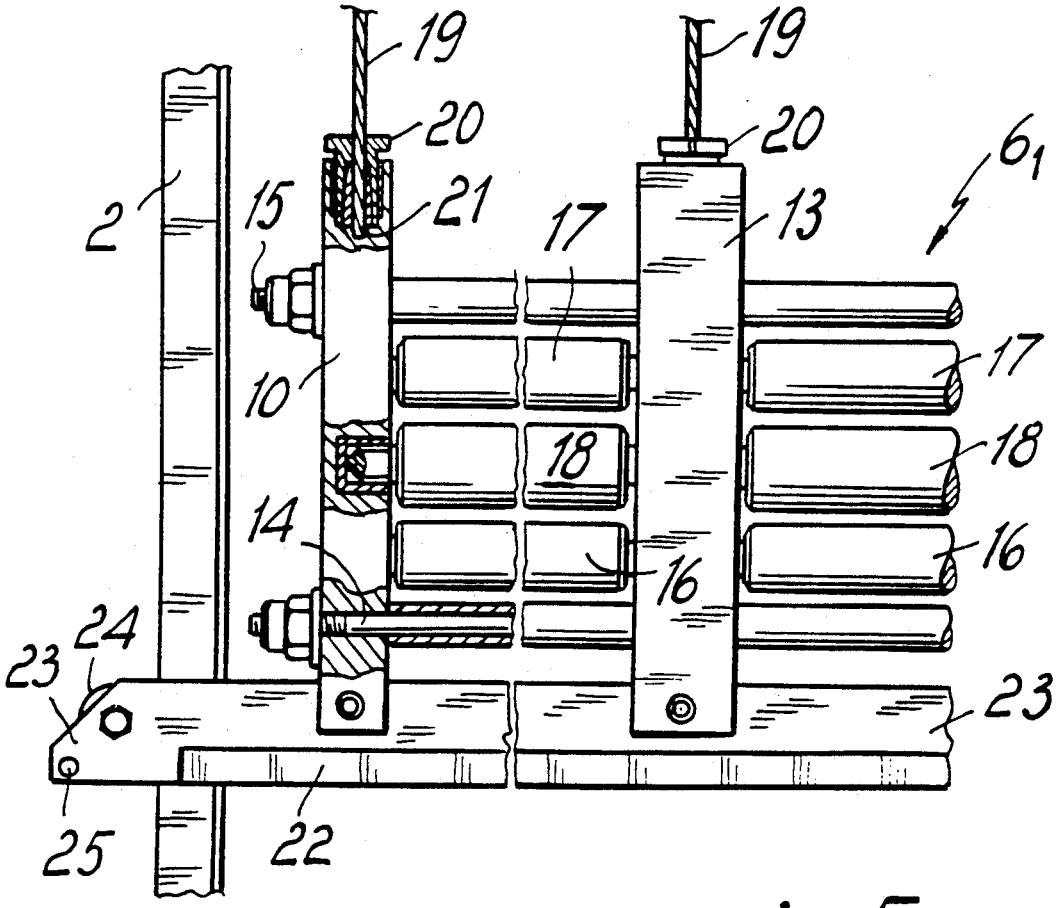
FIG. 5 is a fragmentary enlarged-scale top view of the roller truck of FIG. 3.

The connection between one truck 6 or 8 and the other is preferably ensured by three cables 19, each locked, at its ends, by a clamp 20 with a conical bush 21 which is inserted and fixed in the end of a cross-member 10, 12, 13, for example as illustrated in FIG. 5.

The front truck 61 of the series of roller trucks is coupled to a flat cross-member 22 which advantageously has an inclined planar front and extends beyond the width of the truck, so as to protrude at the sides to define two wings 23. On each wing a roller 24 having a vertical axis is freely mounted to stabilize the truck against the sides of the casting bed 1; an eyelet 25 is advantageously provided in each of said wings 23 for coupling with a traction cable which is pulled by appropriate movement means, such as for example a conventional winch (not illustrated).

By means of the traction exerted by the winch, the truck 61 is moved, and the entire set of roller trucks 62, . . . 6*n* and the train of removal rollers 8 move with it, above the casting bed 1, but below the component 5, which is gradually raised from the bed and simultaneously transferred onto the removal rollers 8 to be subsequently removed from the casting bed 1 and transferred onto the sliding runway 9.

Once the casting bed 1 has been cleared, said bed is ready to be re-used, i.e., cleaned and covered with mold release agent and prepared for being rigged with a new reinforcement frame, while the component 5 on the runway 9 can be advanced toward a fixed cutting or sectioning station 30 arranged downstream of the runway 9 and constituted, for example, by an abrasive or diamonded disk cutter 31.

This allows to simultaneously perform two operations, i.e. the sectioning of the component into segments and the placement of a new reinforcement frame on the casting bed 1 for a new casting, thereby achieving a substantial increase in the productivity or efficiency of the apparatus according to the invention with respect to the known apparatuses.

As can be seen, the sliding runway 9 performs several functions, i.e. it is used to support the trucks 8*a* during the idle step, during advancement of the truck toward the casting bed 1 to load the component 5 onto the trucks and during the return of said trucks 8*a* loaded with the component. The runway 9 is then used for parking or storing the component while waiting for the cutting operation.

The component 5, after storage, can be easily advanced by sliding on the rollers 8 of each truck 8*a*, in a controlled manner toward the cutting station 30, where the various cut segments are received by motorized rollers, generally indicated by the reference numeral 27, to convey said segments to a storage location.

The intermediate bridge-like portion 9*a* of the runway acts as connection between the sliding runway 9 and the casting bed 1 during the step of movement of the component 5, whereas during the idle step it supports the set or train of roller trucks 61, . . . 6*n*. The portion 9*a* is advantageously removable to avoid hindering operations for anchoring and pretensioning the steel frame elements.

Figure 6:
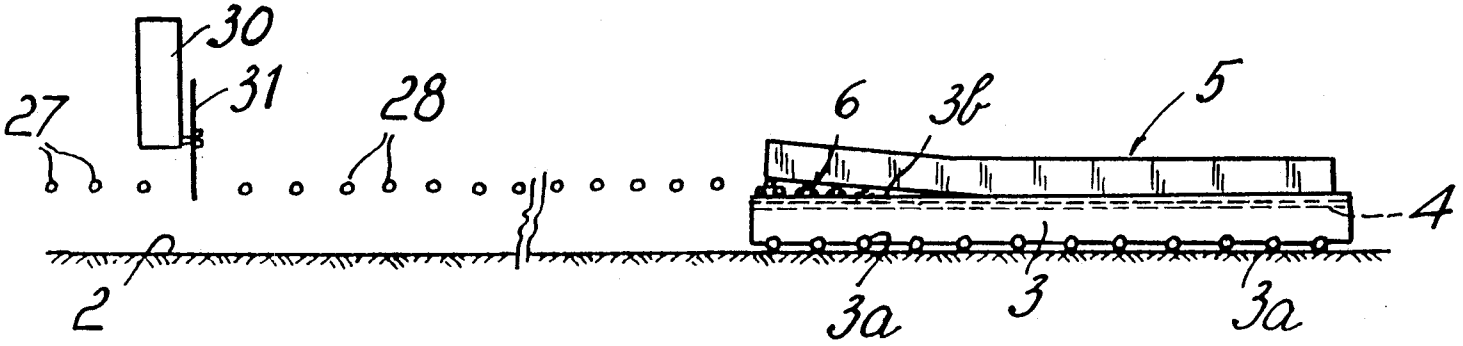
FIG. 6 is a schematic side view of a movable casting bed, on which a set concrete component is cast, at the beginning of the separation from the casting bed.

Instead of being fixed, the casting bed can be movable, as indicated by the reference numeral 3 in FIG. 6, because it is fitted with wheels or rollers 3*a* for moving on floor-mounted runways or tracks 2 which are at least twice as long as the casting bed 3.

Differently from the fixed casting bed 1 of FIG. 1, in the case of the movable bed 3 of FIG. 6 the anchoring head (for example such as the head generally indicated by T1 in FIG. 7) provided at the end of the bed 3 which is furthest from the cutting station 30 can be of a conventional fixed type, provided with a comb and with a cross-member on which the reinforcement bars or cables are inserted and prestressed. The other anchoring head (generally indicated by the numeral T2 in FIG. 7) is constituted by a retention element which is removable or retractable so as to not hinder the free sliding of the movable casting bed 3 after setting of the component 5 and cutting of the reinforcement bars or cables which are locked to the anchors.

Once setting is completed and once the casting bed has been freed from the anchors, the end of the component is raised to allow the insertion of the first roller truck 61 between the component 5 and the casting bed 3. Then the assembly constituted by the casting bed 3 and the component 5 is pushed, by means of an appropriate movement system (for example constituted by a motorized winch and by one or more traction cables), against the fixed roller trucks 6. The roller trucks produce a wedge-like effect between the component 5 and the casting bed 3 until the component 5 is completely raised from the casting bed and reaches a roller bed or a plurality of fixed motorized rollers 28, arranged at the rear end of the train of roller trucks 6 and are aligned at a level which is slightly higher than that of the casting surface 3*b* of the casting bed 3. Once the component 5 has been entirely transferred onto the rollers 28, the casting bed 3 is completely below the rollers 28 and can thus be returned to the initial position between the two anchoring heads to be then rigged again and prepared for a subsequent casting.

In the meantime, the component 5 is moved by the motorized rollers 28 to be transported to the cutting station and cut to the required sizes.

According to a further embodiment of the apparatus according to the present invention, it is possible to provide a fixed casting bed 1, such as the one illustrated in FIG. 1, and the train or set of trucks 8 can be stored on a winding drum (not illustrated) which is arranged or arrangeable at an end of the casting bed 1. Alternatively, said train or set of trucks can be placed on a parking runway which extends below the casting bed along the entire length thereof.

Such a solution can be advantageous in those cases wherein the space available is not sufficient for the setup of a sliding runway 9 as illustrated in FIG. 1. The cutting station 30 can then be provided proximate to an end of the casting bed 1. While the component 5 constantly remains on the casting bed, it is first separated from the casting surface by the train of roller trucks 6 and is transferred onto the train of trucks 8. The component is then slided on the rollers 18 and transported in segments of preset length, to the cutting station 30.

By means of a process and an apparatus as described above, the considerable benefit is achieved of having a fixed cutting station 30 which can easily be made quieter so as to reduce environmental noise pollution and most of all can be provided with a fixed apparatus for recovering, treating and recycling sludge, dust and cutting waste. As known to technicians in the field, cutting performed conventionally with a cutter which can move along the casting bed in fact entails, besides very high noise levels in the factory, the creation of a considerable amount of dust, sludge and pulp at the sides of the casting bed or along the gangways between one casting bed and the other; said sludge causes unpleasant working conditions, must be removed for washing and collected in a pit and must then be taken to a landfill, with considerable disposal costs, and loss.

By means of the proposed system according to the invention, it is instead possible to avoid noise pollution in the casting room and to keep it constantly dry and clean, to the full advantage of both the comfort of the personnel and of the operating economy of the apparatus, since the cutting waste and sludge can be easily recovered and returned to the manufacturing cycle.

With reference to the embodiment of an apparatus illustrated in FIGS. 7 to 12, it can be seen that an apparatus according to the invention comprises a casting station SG, in which a fixed lower runway or track P2 and an upper runway or track P3, spaced above the track P2, are provided.

The length of the tracks P2 and P3 is such that each can receive and support a movable casting bed A1 and A2. Each casting bed is formed (FIG. 11) by a frame 40, which is for example 120 m long and 2.70 m wide, is mounted on wheels 41 and supports a casting surface 42 made of steel plate. Immediately below, the surface 42 is a coil 43 or another pipe system for circulating superheated water or another heat convection fluid.

Advantageously, the wheels 41 are adequately protected against sludge, waste and the like by a covering element 44 which is rigidly connected to the frame 40 and extends along the two side walls of each movable casting bed.

Two fixed shoulders, for example L-shaped shoulders 45, are also provided along each runway or rail of the upper track P3.

Figure 7:
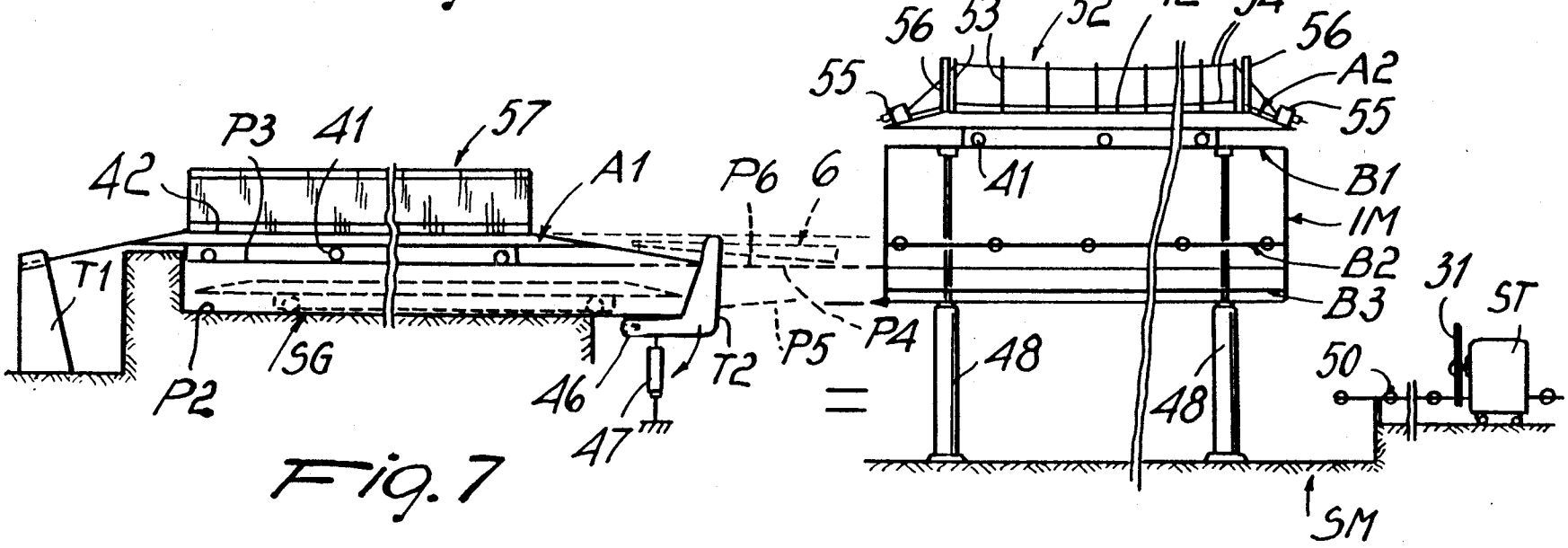
FIG. 7 is a schematic elevation view of a further embodiment of an apparatus according to the invention.
Figure 8:
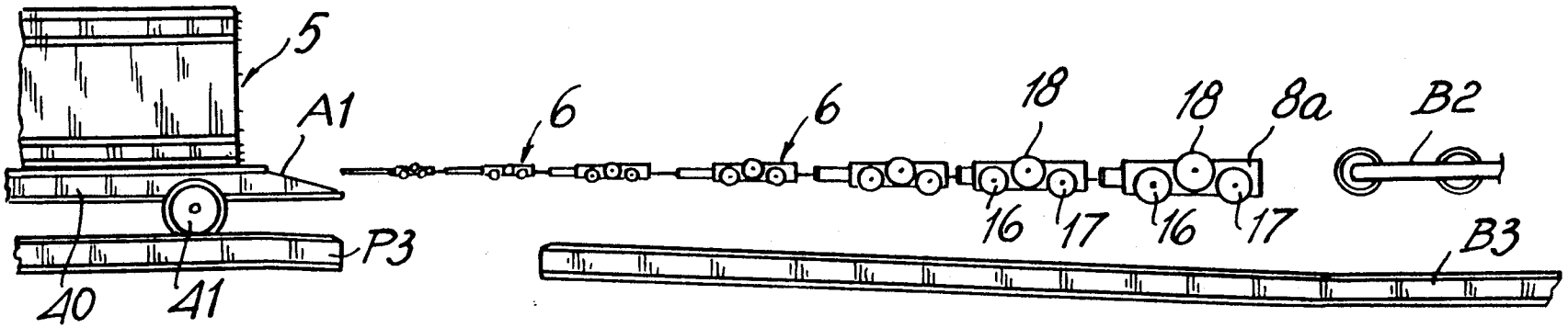
FIG. 8 is a schematic enlarged-scale view of an end of a movable casting bed, which supports one or more components, and a train of roller trucks of the apparatus of FIG. 7.
Figure 9:
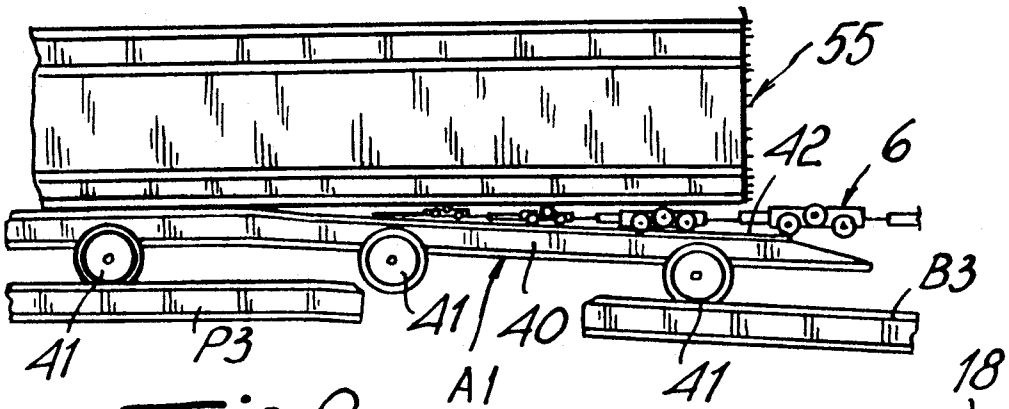
FIG. 9 is a view of the train of roller trucks of FIG. 8 during wedge-like penetration between the casting bed and the components.
Figure 10:
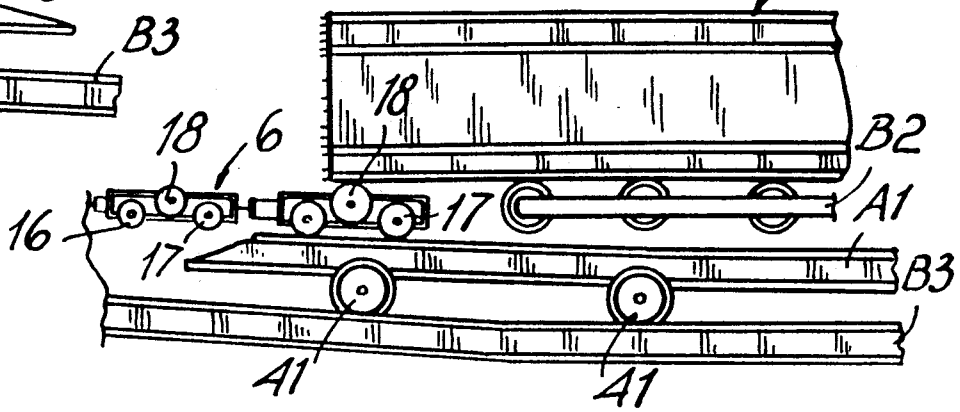
FIG. 10 is a view of the component of FIGS. 8 and 9, after being transferred, by means of the roller trucks, from the casting bed to the roller bed provided on the movable framework.

The casting station SG also comprises, at the end of the track P3, appropriate devices T1 and T2 for pretensioning the steel reinforcement elements (cables or bars). The device T1 to which the steel element pretensioning operation is assigned can be of a conventional type, whereas the device T2 must be of the retracting type, as generally indicated in FIG. 7. The device T2 has been illustrated in the form of an L-shaped lever which is pivoted at pivot point 46 and is provided with a hydraulic jack 47 or with another suitable actuation means for lowering and raising it.

Downstream of the casting station there is a transfer station SM having a movable framework IM, formed by a single frame, for example configured as a prism-like container 125 m long, 3.30 m wide and 2.20 m high. The frame is provided with lifting and lowering means constituted for example by a plurality of hydraulic jacks 48 which are intended to move it in a vertical direction, for example for a total stroke of 2.0 m.

The framework IM is vertically divided into three levels, i.e. an upper level, equipped with runways or tracks B1 suitable for supporting a movable casting bed A1 or A2, an intermediate level B2, constituted by a motorized rollerway or roller bed, and a lower level B3, equipped with a track for accommodating a movable casting bed A1 or A2.

Figure 2:
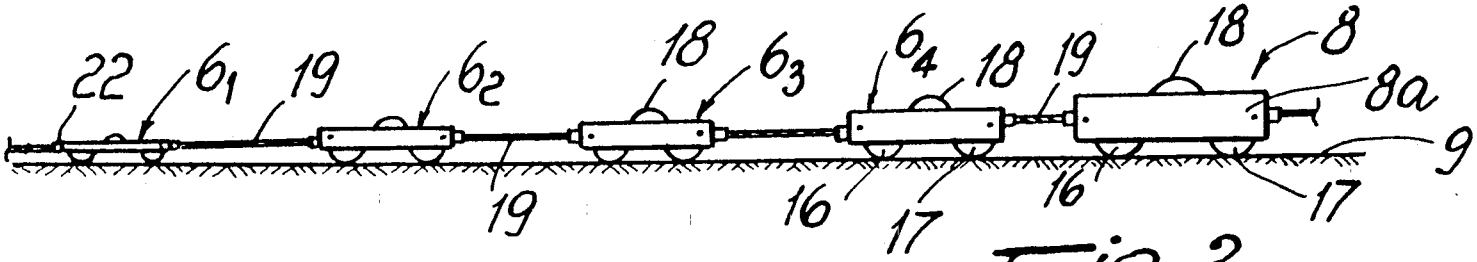
FIG. 2 is a schematic side view of a series or train of roller trucks, in enlarged scale with respect to FIG. 1.
Figure 3:
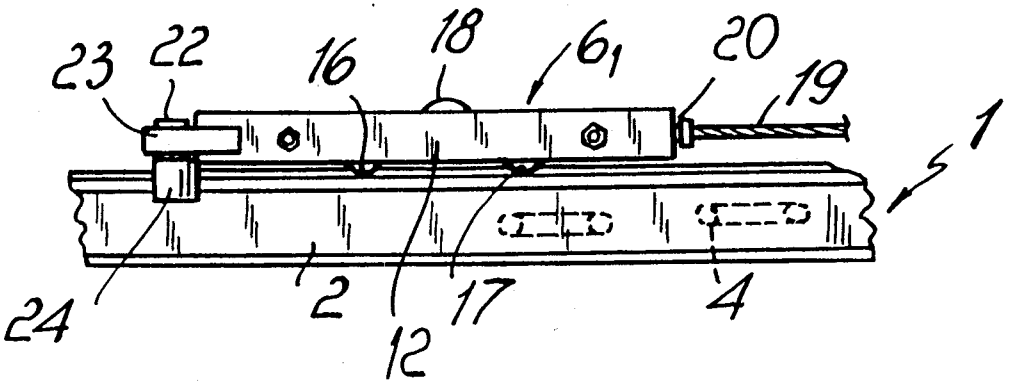
FIG. 3 is a side view of the lower and front roller truck, in enlarged scale with respect to FIG. 2.
Figure 4:
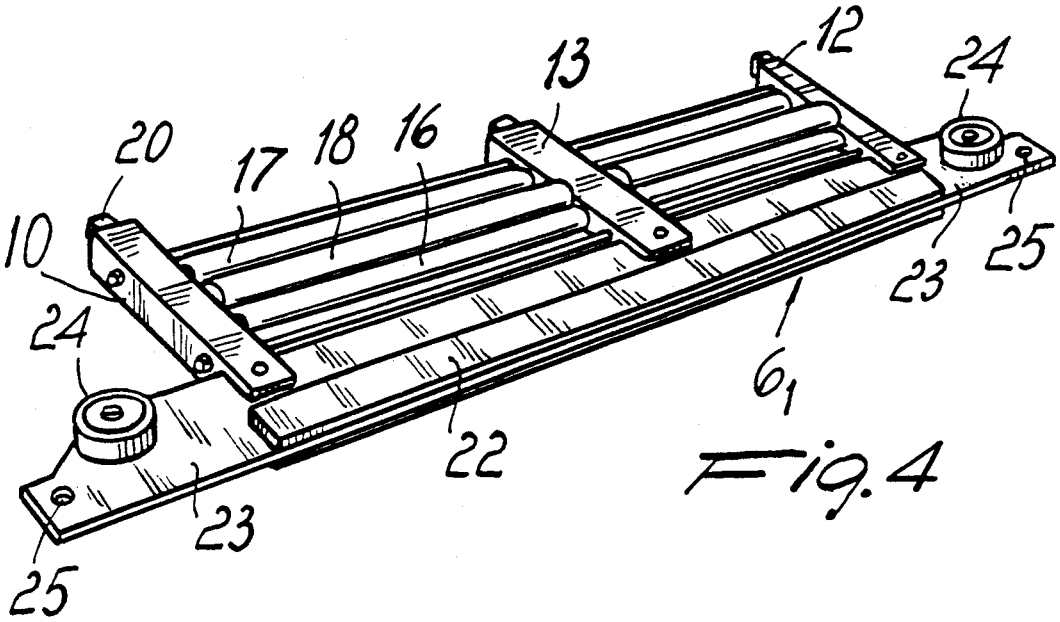
FIG. 4 is a perspective view of the roller truck of FIG. 3, shown in an overturned position.

A plurality of roller trucks 6 similar to that of FIGS. 1 and 2 is provided between the casting station SG and the movable framework IM.

As mentioned, each one of the various trucks 6 has two or more pairs of lower rollers 16 and 17 on supports 10, 12, 13 and an upper free or motorized roller, and they increase in height starting from the end which is proximate to the casting station toward the movable framework IM.

The roller trucks 6 can be kept fixed at the level of the casting surface 42 of the casting bed A1 or slightly below it and in any case above a portion of runway P6 for the transfer of a casting bed A1 from the casting station SG to the lower track B3 on the movable framework IM. A second portion of runway P5 is provided between the tracks B3 on the movable framework IM and the tracks P2 of the casting station SG.

As a final station, the apparatus has a fixed cutting station ST for cutting the concrete components into segments or pieces.

Ahead and after the station ST it is possible to provide a motorized rollerway 50 for feeding the cutting station ST and for removing therefrom the component segments already cut to size.

The operation of the apparatus illustrated in FIGS. 7 to 12 is as follows.

Once the casting surface 42 has been cleaned and covered with a film of mold release agent, the casting bed A2, arranged on the upper level B1 of the movable framework IM, is ready to receive a reinforcement frame 52. More particularly, a plurality of grids 53 made of electrowelded mesh is provided; said grids are aligned on the bed, and then the longitudinal steel elements (cables and bars) 54 are positioned. The two ends of each cable 54 are locked in appropriate terminal cross-members 55 with the interposition of a respective positioning-deflection device 56 with a rounded head for deflecting the cables. The terminal cross-members 55 and the positioning-deflection devices 56 are both removably carried at the ends of the casting bed. The longitudinal steel elements 54 can be tied to the electrowelded mesh grid 53, so that each grid segment 53 is firmly connected to the subsequent one.

When the component to be manufactured has no electrowelded grids, the placement of the longitudinal steel reinforcement elements 54 alone is easier.

During the operations for rigging the bed A2, the bed A1, which is located on the casting station SG, has completed the setting period of the concrete components 57 cast thereon, which are thus prestressed.

The tension of the prestressed steel reinforcement elements is thus transferred from the anchors T1 and T2 to the concrete of the components 57 by means of the disengagement (cutting) of the heads of the components from the anchors.

The casting bed A1, which supports the component or components 57, is caused to slide longitudinally along the runway P6, which may be slightly downwardly inclined, in which case the elasticity of the bed A1 is used for achieving a slight deflection from the horizontal. In its movement, the bed A1 encounters the wedge-like penetration action of the train of roller trucks 6, whereas the framework IM is at the highest level. In this manner, during the advancement of the casting bed A1 toward the framework IM, the components 57 are transferred monolithically to the roller bed B2 (FIGS. 8, 9 and 10), whereas the casting bed A1 advances onto the rails B3 below the roller bed B2.

Starting from this moment, the components 57 temporarily rest on the roller bed B2 until the successive cutting operation is carried out.

Immediately after unloading the components 57, the movable framework IM is lowered, so as to move the roller bed B2 to the level of the track P5, and the bed A1 is moved backward from the tracks B3 to shift, along the track P5, onto the lower track P2 in the casting station SG.

At this point, the movable framework is lowered further until the track B1 is at the level of the track P6 to allow the transfer of the rigged bed A2 along the portion of runway P6 to the upper tracks P3 of the casting station SG in the position suitable for pretensioning the steel reinforcement elements and subsequently for casting.

Figure 11:
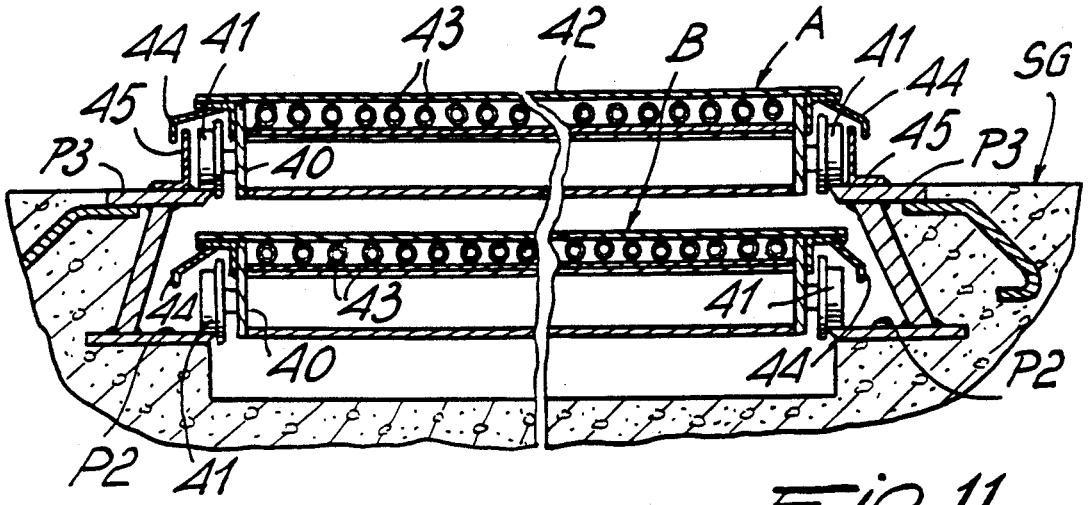
FIG. 11 is an enlarged-scale transverse sectional view of the casting station, with two casting beds spaced apart above one another.

In this step, the bed A2, on the upper tracks P3, and the bed A1, on the underlying tracks P2, are simultaneously in the casting station SG, as illustrated in FIG. 11.

At this point, the movable framework IM is lowered further so that the casting bed A1 resting on the track P2 can be transferred to the upper track B1 at the top of the framework, which subsequently rises to the maximum height, where the casting bed can be cleaned, treated with mold release agent and loaded with a new reinforcement cage 52.

The positions of the beds A1 and A2 are now reversed with respect to those indicated in FIG. 7.

It is thus possible to work on the rigged bed A2, which is at the casting station on the tracks P3. The pretensioning anchor T2, during transfer of the beds from the casting station SG to the movable framework IM and vice versa, is swung down into a retracted position so as to not interfere. Subsequently, the anchor T2 is raised, and the steel reinforcement elements are prestressed between the anchors T1 and T2, acting by means of an appropriate conventional hydraulic pretensioning device.

Once pretensioning is complete, extrusion casting begins by means of an extrusion machine or a vibratory finishing machine, for example of a type well-known in the art, which produces a casting 57, which is e.g., 120 m long. After the finishing operations, the casting 57 is covered with a sheet and hot-set, as mentioned, by circulating superheated water through the pipes 43 below the surface 42 and/or by means of another suitable heating system.

During the operations for casting and setting the components on the bed A2 in the station SG and the preparation of the steel reinforcement frames on the bed A1, while the movable framework IM remains at its lower level, the subsequent cutting operations are performed on each one of the individual and still monolithic components which are placed on the roller bed B2, aligned with the roller bed 20 which feeds the cutting station ST.

Figure 12:
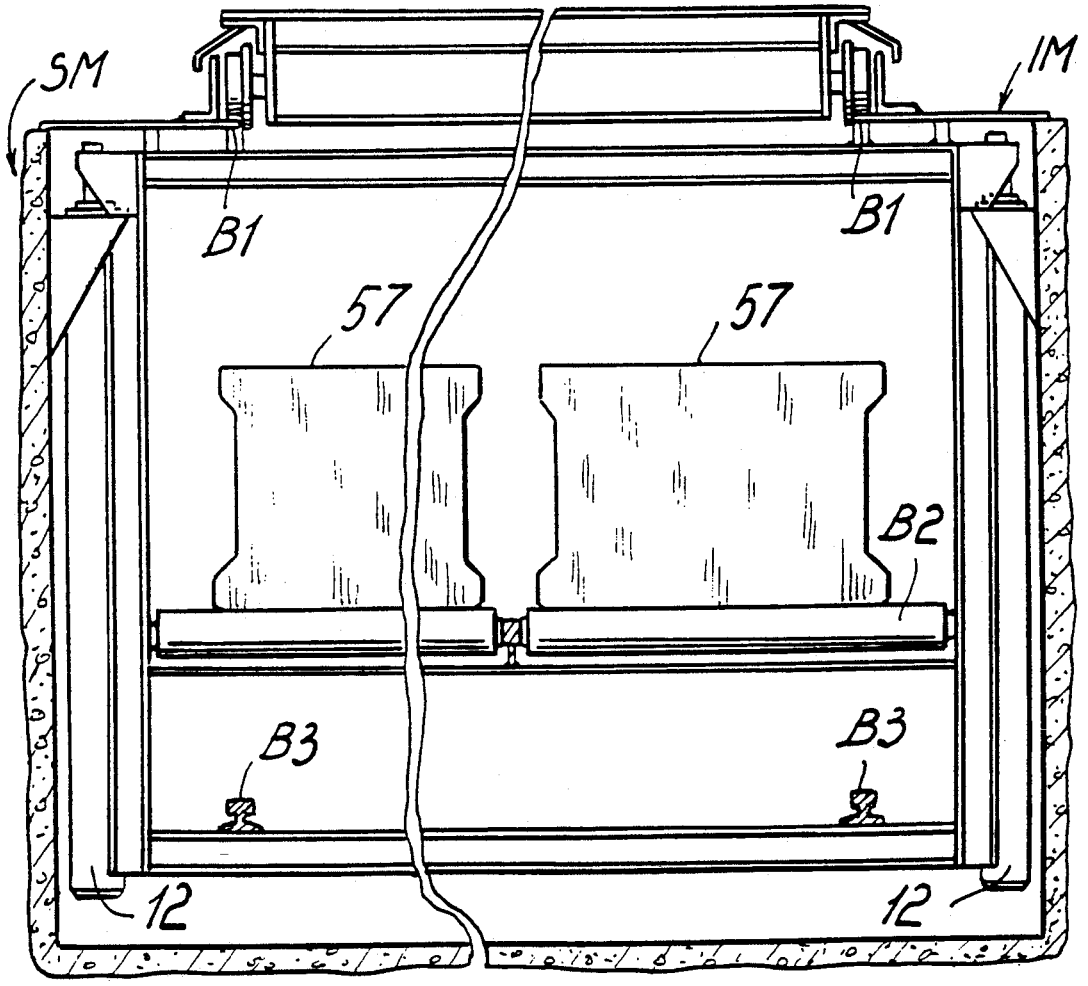
FIG. 12 is an enlarged-scale transverse sectional view of the movable framework, which supports two components which are cast and moved together.

Each motorized roller of the roller bed B2 can be composed of two or more cylinders which are coaxial but rotate independently of one another, as illustrated and exemplified by the roller B2 illustrated in FIG. 12.

This peculiarity of the roller bed B2 allows the longitudinal movement, in segments of a preset length, of only one of the components 57, while the neighboring component or components are left idle.

In this manner, parallel components arranged on the roller bed B2 can be advanced individually toward the cutting station ST, which can perform cuts into pieces of different lengths appropriate for each individual component being manufactured.

The component segments cut to size are removed from the cutting station ST by longitudinal sliding on the roller bed 50 to be taken to a storage area.

Once the cutting operations of all the components 57, which are possibly manufactured in parallel, are complete, the roller bed B2 is empty and available for receiving the new components manufactured in the casting station. A new transfer of beds between the casting station SG and the framework can thus begin in order to start a new production cycle.

Figure 13:
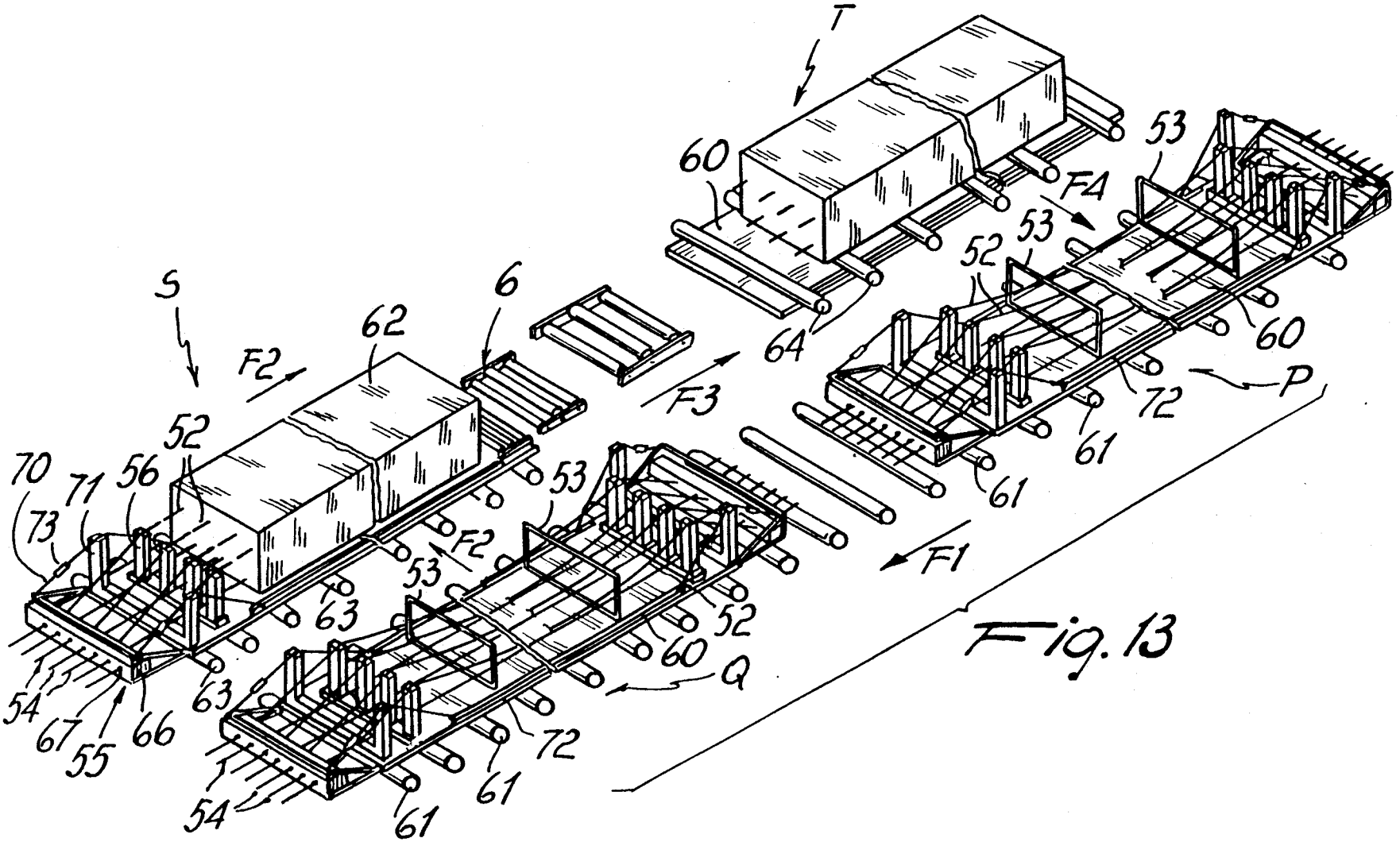
FIG. 13 is a schematic perspective view of another example of apparatus according to the invention, with movable plates.

FIG. 13 is a schematic perspective view of another embodiment of an apparatus according to the invention, which provides transverse movements, as well as longitudinal movements, of movable casting surfaces 60 which are constituted, in this case, e.g., by steel plates which are over 120 m in length, more than 1.20 m wide and 5–15 mm thick.

Starting from a preparation and rigging position or station P, in which a plate 60 is cleaned (for example scrubbed and oiled with mold release agent) and on which a reinforcement frame, for example a reinforcement frame 54 of FIG. 7, is placed, by means of a roller bed with motorized rollers 61. The plate thus prepared is transferred longitudinally (as indicated by the arrow F1) toward a waiting position or storage station Q before being moved transversely (arrow F2) by pushing or pulling, for example by means of appropriate hydraulic jacks, winches and cables (not illustrated) and the like, toward a casting position or station S. In the transfer from the position P to the position Q, the plate 60 rises by for example approximately 30–40 cm, for example by virtue of the rising arrangement of the rollers 61 between the positions P and Q.

The longitudinal rods 52 are prestressed at the station S and then, as previously described, casting is performed by means of a vibratory finishing machine to form a component 62. When the cast component 62 has set, the reinforcement rods are cut.

The casting surface 60, mounted on a roller bed 63 which is parallel to the roller bed 61, is then pushed or pulled in a longitudinal direction (arrow F2) against a train of rollers 6 with a wedge-like penetration effect in order to separate the component 62 from the underlying casting surface 60. Said casting surface, by virtue of its elasticity, as it separates from the component and is advanced in a cantilever manner beyond the roller bed 63, deforms slightly and progressively tilts with respect to the level of arrangement of the lower surface of the component 62 in the direction of the arrow F3. Said component, due to its considerable rigidity, maintains horizontal position and is pushed so as to be transferred onto a roller bed 64 (station T) arranged parallel and co-planar with respect to the roller bed 63, and below which the casting surface 60 is arranged.

The component is moved from the roller bed 64 to a cutting station 30 or ST, while the underlying casting surface 60 is transferred transversely, by pushing or pulling (arrow F4), onto the co-planar preparation station P where a new working cycle can begin.

By using two or three casting surfaces 60 in the apparatus, the operation of said apparatus can be substantially uninterrupted throughout the cycle at each work position or station.

If required, the preparation line formed by the stations P and Q can be arranged between two casting and separation lines constituted by stations S-T and can serve them both, thus allowing the continuous circulation of at least four casting surfaces 60.

More particularly, a terminal cross-member 55 is added head-on to the casting surface or plate 60 at both of its ends once said plate has been transferred to the preparation and rigging station P; said cross-member is formed by a die block 66 which has a plurality of holes provided with a bush 67 for the passage, through said holes, of an end of the longitudinal reinforcement elements 52, as well as two lateral supporting and abutment arms 68 which protrude in a cantilever manner from the block 66 and abut against the edge of the plate. For this purpose, the plate 60 has spaced front abutment seats 69 which allow the arms 68 to oscillate vertically about the adjacent front edge of the plate. Each block 66, which is anchored at the free ends of the arms 68, is in fact kept raised during horizontal transfers from position P to position S by means of a pair of tension elements 70, which are supported by a respective upright or vertical structure 71 and can be fixed to a longitudinal edge of the plate 60.

Advantageously, the plate has two longitudinal edges 72 which are enlarged or constituted by applied strips which, besides acting as reinforcement elements, also constitute very shallow shoulders for confining the concrete casting. The uprights 71 at each end of the plate can furthermore constitute the arms of a U-shaped structure arranged on the plate together with a set of positioning-deflecting devices 56.

Each tension element 70 comprises a clamp 73 or another equivalent elongation-compression means for the correct placement of each cross-member 66 which is lowered, in the pretensioning station S, with respect to the plate 60 in order to be adequately engaged with the anchorings T1 and T2, after which the tension elements 70 and the uprights 71 are removed.

Figure 14:
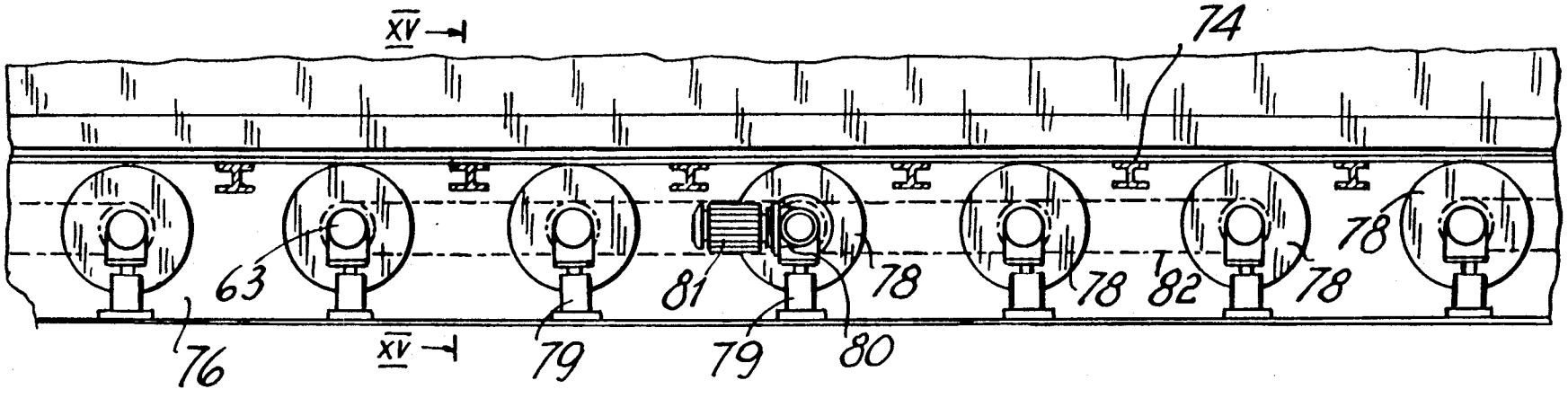
FIG. 14 is an enlarged-scale side view of a portion of the movable-plate casting bed of the apparatus of FIG. 13.
Figure 15:
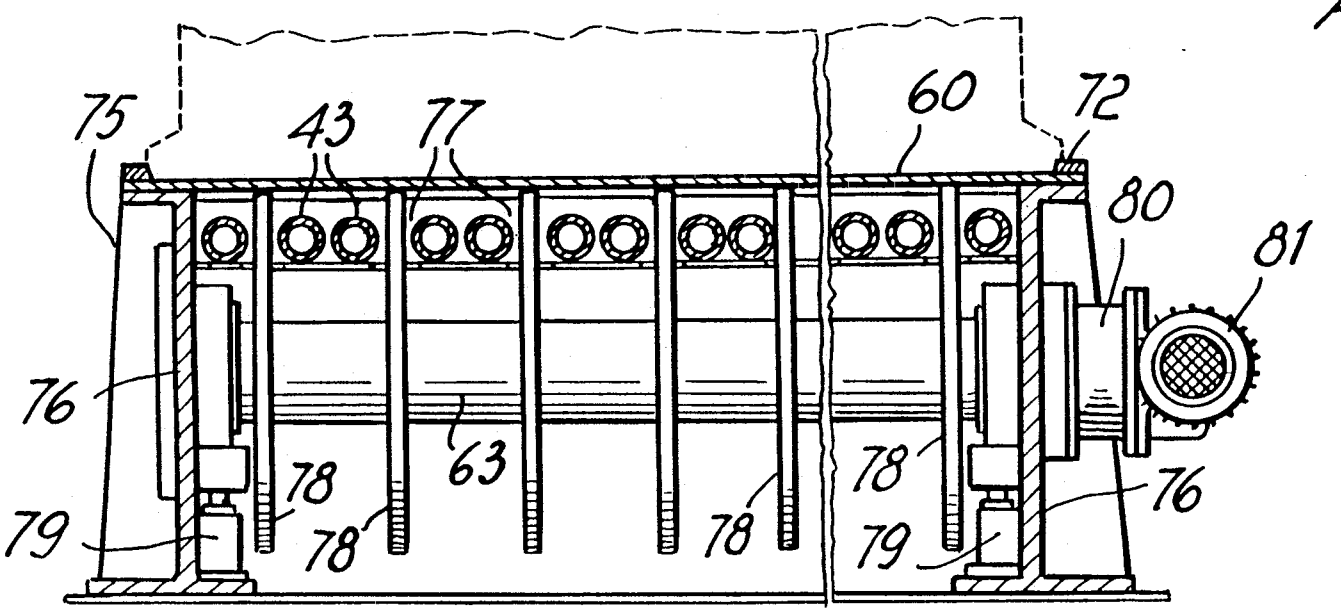
FIG. 15 is an enlarged-scale sectional view taken along the line XV—XV of FIG. 14.
Figure 16:
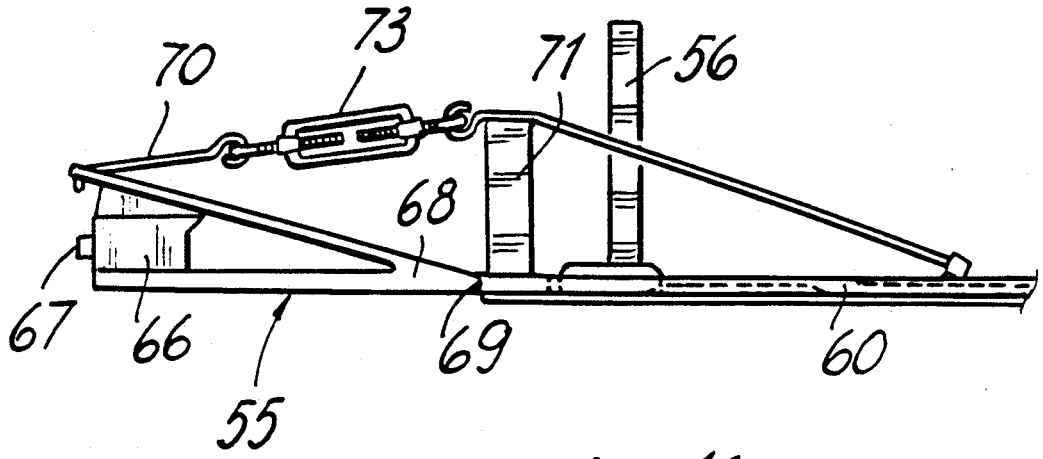
FIGS. 16 and 17 are respectively an elevation view and an enlarged-scale perspective view of details of the apparatus of FIG. 13.
Figure 17:
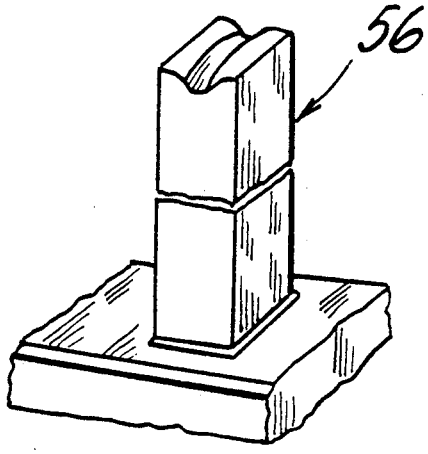

The casting bed 75 (FIGS. 14 and 15) in the station S is formed by two parallel sides 76, preferably made of steel, which are connected by a plurality of perforated cross-members 74, between which the sequence of rollers 63 is supported. A casting plate 60 can be transferred and supported at the top of the sides 76; said plate simply rests on the sides 76 and on the connecting cross-members 74, and pipes 43, inserted in the holes of the cross-members 74 for the conveyance of a fluid heating means and grouped so as to delimit vertical passages 77 between them, run directly below the plate 60. The cross-members 74 therefore have the function of stiffening the casting bed and constitute more closely spaced supports for the plate 60. An equal number of metallic disks 78 extends through the passages 77; said disks are keyed in sets onto the rollers 63. The disks 78 have such a diameter as to be normally flush with the top of the side walls 76.

Each roller 63 is supported, at its ends, by a jack 79 which extends vertically to raise the respective roller and thus the plate 60 during the advancement thereof toward the station T. For this purpose, some rollers 63 are kinematically connected by means of a reduction unit 80 to an electric motor 81 and transmit the motion, by means of a chain transmission 82, also to other driven rollers 63.

Once the transfer to the position S of an appropriately rigged plate 60 as described above has occurred, the blocks 66 are lowered until they connect to the anchorings T1 and T2. The steel elements 52 which pass through the blocks 66 are prestressed, and casting is performed so as to obtain a component 62 which is allowed to set. Then the steel prestress elements are relaxed and cut in the region between the positioning-deflecting devices 56 and the head of the component, the terminal cross-members 55 and the positioning-deflecting devices 56 are removed from the plate (to be transferred and positioned on a plate 60 in the station P), and the plate 60 is advanced, by virtue of the rise of the rollers 63, together with its load, which is now constituted only by the component 62, toward the cutting station T.

The plate 60 initially protrudes from the roller bed 63 in a cantilever manner and is partially lowered due to elastic deformation, while at the same time a train of roller trucks 6 is inserted between the plate and the component and gradually receives the component 62 before transferring the component above the roller bed 64, allowing the plate to advance below said rollers 64.

The advantages offered by the industrialized manufacture of prestressed concrete components manufactured in a continuous cycle on the movable-bed production line as described above are more evident if one envisages a production facility which contains two or more production lines with adjacent movable beds, wherein the work steps of each line are shifted with respect to one another, moving rhythmically from one production line to the other.

I claim:

1. An apparatus for producing prefabricated reinforced concrete components, comprising: at least one casting bed having heating means; a reinforcement member pretensioning device; at least one finishing machine movable along the casting bed for casting a component; cutting means for cutting the reinforcement members; a plurality of roller trucks of increasing height for wedge-like penetration between the component and casting bed, the roller trucks slidingly arranged on a support aligned with the casting bed; a sliding roller bed at a rear end of the plurality of roller trucks, of a length equal to the casting bed length; actuation means for generating relative motion between the roller trucks, sliding roller bed and casting bed, transferring the component from the casting bed to the sliding roller bed; and a cutting station for cutting the component into segments.

2. The apparatus of claim 1, further comprising, between said at least one casting bed and the cutting station, a transfer space having a length longer than the casting bed and extending in alignment with a respective casting bed, said transfer space containing a rolling runway for said sliding roller bed and said plurality of roller trucks, and wherein said casting is fixed.

3. The apparatus of claim 1, further comprising, between said at least one casting bed and the cutting station, a transfer space having a length longer than the casting bed, said transfer space containing a rolling runway for the casting bed which is movable thereon and the sliding roller bed which is fixed and aligned with said casting bed.

4. The apparatus of claim 1, wherein each roller truck of said plurality of roller trucks comprises: a frame which has at least two side walls; a plurality of cross-members interconnected between said side walls; at least one pair of lower rollers and at least one upper roller for the support and advancement of the component, said lower rollers and said upper roller being mounted between said side walls; and means for connection and traction between one truck and a following truck.

5. The apparatus of claim 4, wherein said means for connection and traction comprise a plurality of clamps anchored to ends of said cross-members and a plurality of cables or chains interconnected between clamps provided on successive roller trucks, said at least one upper roller being provided with motor means for advancing the component after separation from said casting bed.

6. The apparatus of claim 1, wherein said plurality of roller trucks comprises a front roller truck being lower in height than the other roller trucks and having, at a front end thereof, a traction cross-member which is wider than the width of said successive roller trucks and having ends each defining a free guiding roller for laterally slidingly engaging the casting bed.

7. The apparatus of claim 3, wherein said at least one casting bed is provided with roller means for allowing said casting bed to move longitudinally along guide means to advance from a casting position to said transfer space in order to separate said component from said casting bed.

8. The apparatus of claim 3, further comprising a device for retracting the anchor head of the reinforcement members so as not to hinder advancement of the movable casting bed with the overlying component.

9. The apparatus of claim 3, wherein said sliding roller bed comprises a plurality of fixed motorized rollers which are spaced from one another and are suitable for supporting a component to be cut and for imparting to said component sequential advancement motions of a preset length so as to cut said component to size at the cutting station.

10. The apparatus of claim 1, wherein said cutting station comprises means for conveying and collecting material such as dust, sludge and cutting waste to a device for treating and recovering the material.

11. The apparatus of claim 1, comprising: at least two casting beds which are equal in length and are mounted on wheels so that said at least two casting beds are movable along transfer paths; at least one pair of runways or tracks spaced one above the other at a casting station; a station for moving the casting beds which is provided with a movable supporting framework which can be raised and lowered, is substantially as long as said at least two casting beds and supports said sliding roller bed; an upper track and a lower track for the casting beds and actuation means for lifting and lowering said framework; said plurality of roller trucks being arranged between the casting station and the moving station for separating a component from one of said casting beds arriving from said casting station and for transporting said component horizontally to said roller bed in said transfer station.

12. The apparatus of claim 11, comprising, at each end of each casting bed, a device for positioning and deflecting the reinforcement members and a terminal cross-member provided with openings for inserting ends of steel prestressed elements, each said device for positioning and deflecting and each terminal cross-member being removably arranged on the casting bed in said transfer station during a rigging of the casting beds.

13. The apparatus of claim 11, wherein said reinforcement member pretensioning device is retractable and wherein the apparatus further comprises means for lowering and raising the reinforcement member pretensioning device.

14. The apparatus of claim 11, wherein said roller bed supported by the movable framework is formed by a plurality of twin rollers which are coaxial and motorized but are independent of one another so as to move, one after the other, two components located on said roller bed.

15. The apparatus of claim 11, wherein said actuation means comprise a system of hydraulic cylinder-and-piston units.

16. The apparatus of claim 1, wherein said casting bed is formed by a metallic plate which is movable horizontally from a preparation and rigging station to a waiting station and from said waiting station to a casting station and is separable by elastic deformation from the component cast thereon during its upward or downward transfer from the casting station to the component cutting station.

17. The apparatus of claim 16, wherein said metallic plate comprises two shoulders for delimiting the casting and two removable heads for positioning and guiding steel prestressed elements.

18. The apparatus of claim 16, wherein said casting station comprises: two fixed side walls mutually connected by a plurality of cross-members and supporting said metallic plate; a plurality of spaced rollers or shafts rotatably mounted between said side walls, each supporting at least two wheels diametrically larger than said rollers; means for lifting and lowering said spaced rollers with respect to said side walls; and means for motorizing said rollers for removing said metallic plate from said casting station.

* * * * *